United States Patent [19]

Suga et al.

[11] Patent Number: 4,934,347

[45] Date of Patent: Jun. 19, 1990

[54] VARIABLE COMPRESSION PISTON ARRANGEMENT FOR INTERNAL COMBUSTION ENGINE

[75] Inventors: Seiji Suga, Atsugi; Tatsuyuki Matsuya, Fujisawa; Seinosuke Hara, Yokosuka; Hiromichi Ofuji, Yokohama; Takayuki Arai, Yokosuka; Takaharu Goto, Yokohama, all of Japan

[73] Assignees: Nissan Motor Co., Ltd.; Atsugi Motor Parts Co., Ltd., both of Japan

[21] Appl. No.: 208,312

[22] Filed: Jun. 15, 1988

[30] Foreign Application Priority Data

| | | | |
|---|---|---|---|
| Jun. 18, 1987 | [JP] | Japan | 62-93708[U] |
| Jun. 23, 1987 | [JP] | Japan | 62-155742 |
| Aug. 4, 1987 | [JP] | Japan | 62-119318[U] |

[51] Int. Cl.[5] ..... F02B 75/04

[52] U.S. Cl. ..... 123/78 B; 123/48 B

[58] Field of Search ..... 123/48 R, 48 B, 78 R, 123/78 B, 78 BA, 193 R, 193 P

[56] References Cited

U.S. PATENT DOCUMENTS

| | | | |
|---|---|---|---|
| 3,161,112 | 12/1964 | Wallace et al. | 123/48 B |
| 3,403,662 | 10/1968 | Blackburne | 123/48 B |
| 4,286,552 | 9/1981 | Tsutsumi | 123/48 B |
| 4,342,291 | 8/1982 | Lewis | 123/78 B |
| 4,809,650 | 3/1989 | Arai et al. | 123/78 B |

FOREIGN PATENT DOCUMENTS 5825637 8/1956 Japan .

*Primary Examiner*—Craig R. Feinberg

*Attorney, Agent, or Firm*—Lowe, Price, LeBlanc, Becker & Shur

[57] ABSTRACT

The pressure prevailing in a variable volume chamber which controls the compression ratio developed by a piston, is used control the movement of a valve which regulates the supply and draining of the chamber. During high load the high pressure is used to drain the chamber while under light load the lower pressure permits the chamber to be supplied with hydraulic fluid in a manner which tends to fill the same during induction phases and the like when the pressure in the cylinder is low.

17 Claims, 10 Drawing Sheets

VARIABLE COMPRESSION PISTON ARRANGEMENT FOR INTERNAL COMBUSTION ENGINE

BACKGROUND OF THE INVENTION

1. Field of the Invention

The present invention relates to an internal combustion engine and more specifically to an arrangement which permits the compression ratio of the engine to be selectively controlled.

2Description of the Prior Art

FIG. 1 shows a prior art arrangement disclosed in Japanese Utility Model Pre-Publication 58-25637. This arrangement includes an outer piston 10, an inner piston 12 reciprocatively received within the outer one in a to define a first variable volume chamber 14, piston pin 16 which extends through the inner and outer pistons 10, 12, and a con-rod 18 which operatively interconnects the piston pin 16 with a crankshaft of the engine (not shown). An annular retainer 20 is threadedly received in the lower portion of the outer piston 10. This member is formed with a horizontally extending flange portion 21 which cooperates with a step formed in the bottom of the inner piston 12 to define an annular shaped variable volume chamber 22.

A source of hydraulic fluid under pressure generally denoted by the numeral 24 includes a sump or oil pan 26 , a pump 28 which inducts oil from the pan, and a control circuit 30 which is responsive to a plurality of sensors 32 and which controls the operation of the pump 28. In the above mentioned document the sensors 32 are disclosed as being ones which sense the driving condition parameters.

The output of the pump 28 is supplied to the first variable volume chamber 14 via a first passage 34 which is bored or similarly formed in the con-rod 18, a second passage arrangement 36 formed in the piston pin 16 and a third passage 38 which extends through the inner piston 12 to the first variable volume chamber 14.

A one-way valve 40 is disposed at the downstream end of the third passage 38 and arranged to prevent the back flow of hydraulic fluid which passes therethrough.

A control valve arrangement is disposed in a bore formed in the inner piston 12. This valve (as shown in FIG. 2) includes a spool 42 which is biased in one direction by a spring 44. This valve is arranged to be responsive to the pressure prevailing in the first, second and third passages 34, 36, 38 in a manner to control the amount of hydraulic fluid which is permitted to drain from the first variable volume chamber 14 via a fourth passage 46 which extends through the inner piston 14. The downstream end of a drain passage 48 which leads from the bore in which the spool 42 is disposed, is arranged to open into the inner periphery of the inner piston 12 as shown, to permit the hydraulic fluid to precipitate down toward the engine crankshaft and the oil pan 26 of the engine. A one-way valve 50 is disposed in the upstream end of the fourth passage 46 and arranged to prevent the return of any fluid which has flow out of the first variable volume chamber 14 into the fourth passage.

When the pressure discharge by the pump 28 increases the spool 42 of the control valve is biased against the spring 44 in a manner which tends to prevent the flow of hydraulic fluid through the fourth passage 46 and thus ensure that the pressure in the first variable volume chamber 14 reaches that prevailing in the first, second and third passages 34, 36, 38.

As will be appreciated, as the pressure in the first variable volume chamber 14 increases the outer piston 10 is biased to rise up away from the inner one 12 and in a direction which increases the compression ratio of the engine.

On the other hand, when the pressure discharge of the pump 28 lowers, the spool 42 of the control valve tends to move to the left as seen in the drawings and thus tend to open the fourth passage 46 in a manner which permits the hydraulic fluid which has been supplied into the first variable volume chamber 14 to be drained into the second annular variable volume chamber 22.

By controlling the level of the pressure discharged by the pump 28, the degree by which the outer piston 10 is displaced from the inner one can be controlled and thus permit the compression ratio of the engine to be controlled.

This form of compression control is highly advantageous in that, at low engine speeds a higher compression provides good engine response and acceleration while at higher engine speeds a lower compression ratio permit the engine speed to be increased without the fear of engine knock and/or in the worst case severe engine damage.

This particular type of control also lends itself advantageously to use in Diesel engines which inherently have a high compression ratio. Viz., with Diesel engines the high compression ratio leads, under certain modes of engine operation, to the situation wherein the friction loss causes a power output reduction.

However, the arrangement disclosed above has suffered from a number of drawbacks which tends to inhibit practical application.

The first of these comes in that, during low compression operation wherein the first or upper variable volume chamber 14 is drained and the engine is operating at high speeds and a large amount of fuel is being combusted, the heat generated by the combustion causes the oil retained in the upper section of the third passage 38 in which the one-way valve 40 is disposed, to undergo degradation upon a given amount of exposure, and induce the formation of gummy tar residues and deposits which tend to block conduits and valves and otherwise accumulate in a manner which inhibits proper operation.

A second drawback comes in that a special pump must be provided. Viz., the output of the normal engine oil pump cannot be used as the output thereof is low at low engine speeds and cannot provide the required pressure level.

A yet further drawback occurs when it is required to reduce the compression ratio toward a lower value and it is necessary to drain the first variable volume chamber 14. During this operation the oil from the first variable volume chamber 14 is transferred to the second annular one 22 via the fourth passage 46. However, the cross-sectional area and volume of the second variable volume chamber 22 is less than the first 14. Thus, as the amount of fluid which must be transferred is greater than can be received in the lower chamber 22.

During this mode the provision of seal elements 52, 54 on the inner piston 12 prevents leakage from the lower chamber 22. Accordingly, the problem that the hydraulic fluid cannot be readily removed from the upper chamber 12 occurs. This tends to deteriorate the high to low compression transition response characteristics of the device.

In addition to this the above mentioned system requires sensors control the pressure being supplied through conduit 34. This of course adds to the cost and complexity of the system.

SUMMARY OF THE INVENTION

It is an object of present invention to provide an arrangement which enables the compression of an internal combustion engine to be automatically and responsively varied in response to engine load without the need for a special pump, complex sensors and the like.

It is a further object of the invention to provide an arrangement which prevents the formation of gummy tar deposits within the operating chambers of the device.

In brief, the above objects are arranged are achieved by an arrangement wherein the pressure prevailing in a variable volume chamber which controls the compression ratio developed by a piston, is used control the movement of valve which regulates the supply and draining of the chamber. During high load the high pressure is used to drain the chamber while under light load the lower pressure permits the chamber to be supplied with hydraulic fluid in a manner which tends to fill the same during induction phases and the like when the pressure in the cylinder is low.

More specifically, a first aspect of the invention features an internal combustion engine including: a cylinder; a first piston reciprocatively disposed in the cylinder, the first piston having an axial blind bore formed therein, the first piston being directly exposed to the pressure prevailing in the cylinder; a second piston reciprocatively disposed in the axial blind bore to define a first variable volume chamber therein, the second piston being retained in the blind bore, the retainer defining a second annular variable volume chamber between it and the second piston; a piston pin which operatively interconnects a connecting rod with the second piston; a source hydraulic fluid under pressure; a valve bore formed in the piston pin, the valve bore being arranged to be in constant communication with the source; a supply passage formed in the second piston, the supply passage leading from the valve bore to the first variable volume chamber; a drain passage formed in the second piston, the drain passage fluidly communicating with the first variable volume chamber; a valve element disposed in the valve bore, the valve element being responsive to the pressure prevailing in the first variable volume chamber and arranged so that when the pressure in the first variable volume chamber is below a predetermined value, the valve element assumes a first position wherein drain passage is cut-off and communication between the first variable volume chamber and the supply passage is fully established, and when the pressure in the first variable volume chamber is above the predetermined value, the valve element assumes a second position wherein communication between the valve bore and the first variable volume chamber by way of the supply passage is one of cut-off and restricted and the drain passage is opened.

A second aspect of the present invention is deemed to Comprise: a variable compression piston featuring: a first piston reciprocatively disposed in a cylinder, the first piston having an axial blind bore formed therein, the first piston being directly exposed to the pressure prevailing in the cylinder; a second piston reciprocatively disposed in the axial blind bore to define a first variable volume chamber therein, the second piston being retained in the blind bore, the retainer defining a non-hermetically sealed second variable volume chamber between it and the second piston; a piston pin which operatively interconnects a connecting rod with the second piston; means defining a passage structure which is fluidly communicable with a source of hydraulic fluid under pressure; a stepped bore formed in the piston pin, the stepped bore being arranged to be in constant communication with the source by way of a first one-way valve; a supply passage formed in the second piston, the supply passage leading from the stepped bore to the first variable volume chamber, the supply passage including a second one-way valve; a drain passage formed in the second piston, the drain passage fluidly communicating the first variable volume chamber with the stepped bore; a transfer passage which leads from the first variable volume chamber to the stepped bore, the transfer passage including means for restricting the flow of hydraulic fluid therethrough; a spool valve reciprocatively disposed in the stepped bore, the spool valve being movable between first and second positions, the spool having first and second lands, the first land having a smaller diameter than the second land, the spool being biased by a spring toward the first position, the first and second lands defining an essentially cylindrical chamber within the stepped bore, the cylindrical chamber constantly communicating with the source; the first land closing the drain passage and establishing fluid communication between the supply passage and the source when the spool assumes the first position, the first land opening the drain passage and one of closing and restricting the fluid communication between the source and the supply passage when it assumes the second position, the second land cooperating with the transfer passage, the second land having a reduced diameter portion which defines an annular clearance between it and the wall of the stepped bore, the reduced diameter portion juxtaposing the transfer passage when the spool assumes the first position in a manner that communication between the transfer passage and the cylindrical chamber is established through the annular clearance, the second land defining an effective surface area against which the pressure prevailing in the cylindrical chamber acts to produce a bias which tends to move the spool from the first position to the second position against the bias of the spring.

A further aspect of the invention is deemed to come in that the above variable compression piston further comprising a damping arrangement which damps the movement of the spool in the stepped bore, the damping device comprising: a second stepped bore formed in the spool; a piston reciprocatively disposed in the second stepped bore, the piston being arranged to be essentially stationary with respect to the spool, the piston defining a third variable volume chamber within the second stepped bore, the stepped bore being fluidly communicated with the cylindrical chamber by way of a small diameter flow restricting passage.

Another aspect of the invention comes in that the above mentioned variable compression piston features the arrangement wherein the spool is received in the stepped bore in a manner to define an annular variable volume chamber, the annular variable volume chamber being fluidly discrete from the cylindrical chamber and fluidly communicated with the transfer passage, the pressure prevailing in the annular variable volume chamber producing a bias which tends to move the spool toward the second position.

A fifth aspect of the invention is deemed to comprise a variable compression piston which includes: a first piston reciprocatively disposed in a cylinder, the first piston having an axial blind bore formed therein, the first piston being directly exposed to the pressure prevailing in the cylinder; a second piston reciprocatively disposed in the axial blind bore to define a first variable volume chamber therein, the second piston being retained in the blind bore, the retainer defining a non-hermetically sealed second variable volume chamber between it and the second piston; a piston pin which operatively interconnects a connecting rod with the second piston; means defining a passage structure which is fluidly communicable with a source of hydraulic fluid under pressure; a stepped bore formed in the piston pin, the stepped bore being arranged to be in constant communication with the source by way of a first one-way valve; a supply passage formed in the second piston, the supply passage leading from the stepped bore to the first variable volume chamber, the supply passage including a second one-way valve; a drain passage formed in the second piston, the drain passage fluidly communicating the first variable volume chamber with the stepped bore; and a spool valve reciprocatively disposed in the stepped bore, the spool valve being movable between first and second positions, the spool having first and second lands, the first land having a smaller diameter than the second land, the spool being biased by a spring toward the first position, the first and second lands defining an essentially cylindrical chamber within the stepped bore, the cylindrical chamber constantly communicating with the source; the first land closing the drain passage when the spool assumes the first position, the first land opening the drain passage when the spool is moved from the first position toward the second one, the first land being formed with a surface which is exposed to the pressure prevailing in the drain passage and producing a bias which tends to move the spool toward the second position against the bias of the spring, the second land being arranged so that the pressure prevailing in the cylindrical chamber biases the spool toward the second position against the bias of the spring.

DETAILED DESCRIPTION OF THE PREFERRED EMBODIMENTS

FIRST EMBODIMENT

Figure 1:
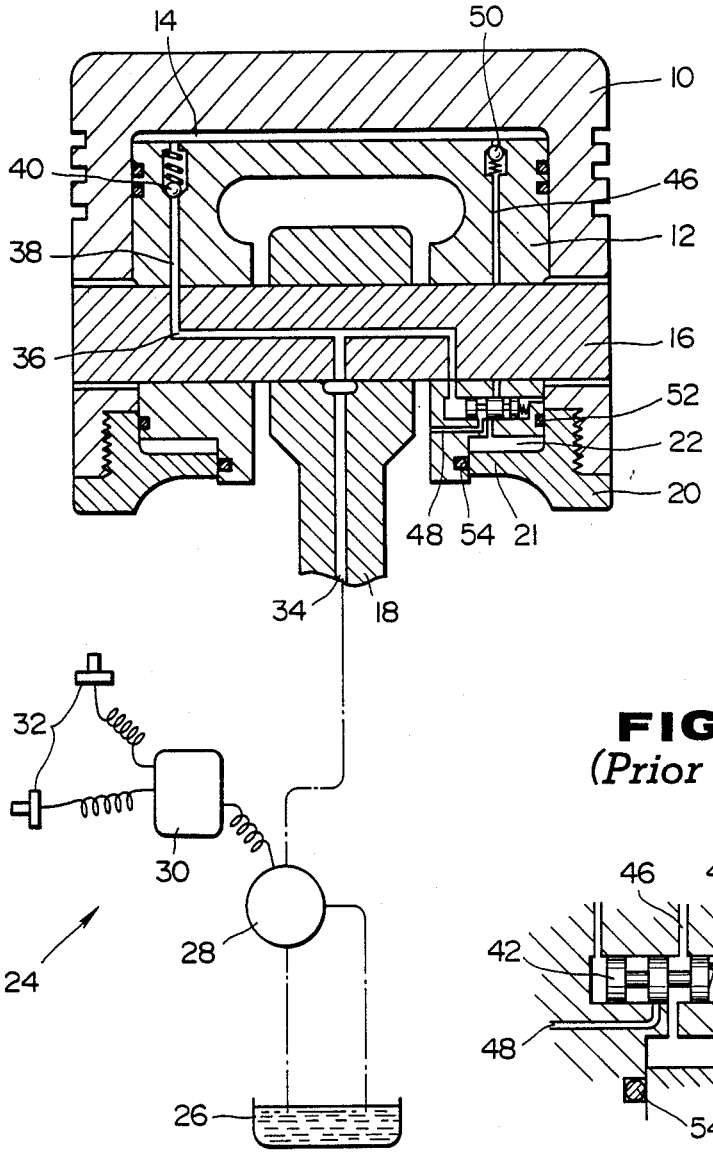
FIG. 1 (Prior Art)
FIG. 1 is a front sectional elevation of the prior art arrangement discussed in the opening paragraphs of the instant disclosure.
Figure 2:
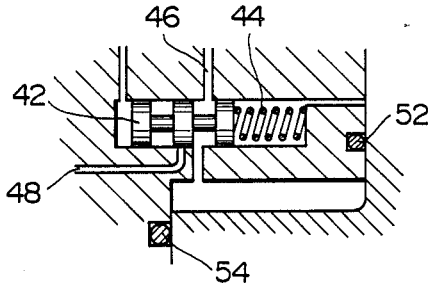
FIG. 2 (Prior Art)
FIG. 2 is an enlarged view of the control valve which is used in the arrangement depicted in FIG. 1.

FIGS. 3 to 6 show a first embodiment of the present invention. In this arrangement an inner piston 100 is reciprocatively received in a blind bore formed in an outer piston 102 is a manner to define a first variable volume chamber 104 therein. An annular retainer 106 is disposed in the lower portion of the outer piston 102 in a manner to limit the amount of movement of the inner piston 100 within the outer one and simultaneously cooperate with step formed in the inner piston 100 to define a second annular variable volume chamber 108.

The connection between the inner piston 100 and the retainer 106 is such as to define a non-hermetic interface and permit a certain predetermined rate of leakage when the chamber 108 is pressurized The reason for this will become more apparent hereinafter.

A connecting rod 109 is connected to the inner piston 100 by a piston pin 110 which in this embodiment is formed with a stepped bore in which a spool valve element 112 is disposed The spool valve 112 comprises a large diameter land 112A and a small diameter 112B land interconnected by a shaft section 112C. The large diameter land 112A is stepped in a manner to define a narrow annular clearance between the bore and the smaller diameter section 112A' of the land.

The piston pin 110 is retained in placed in a through bore formed in the inner piston 100 by way of snap rings. As shown, the length of the piston pin is less than the diameter of the inner piston 100.

Annular stopper members 114, 116 are disposed in the ends of the stepped bore in a manner to retain the spool valve element 112 therein. In this arrangement stopper member 114 is formed with a concentric opening which in this instance acts as a drain port 114A.

Figure 3:
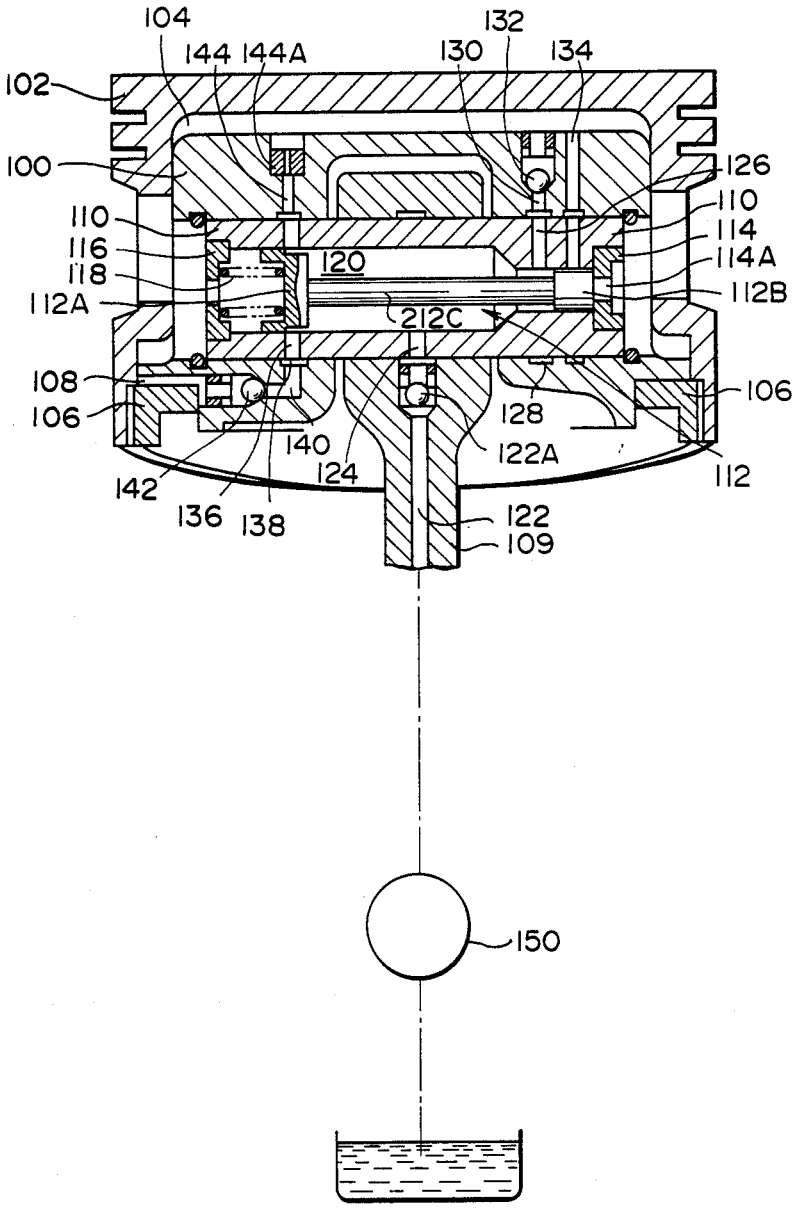
FIGS. 3 and 4 are front and side sectional elevations showing a first embodiment of the present invention conditioned for high compression ratio operation.
Figure 4:
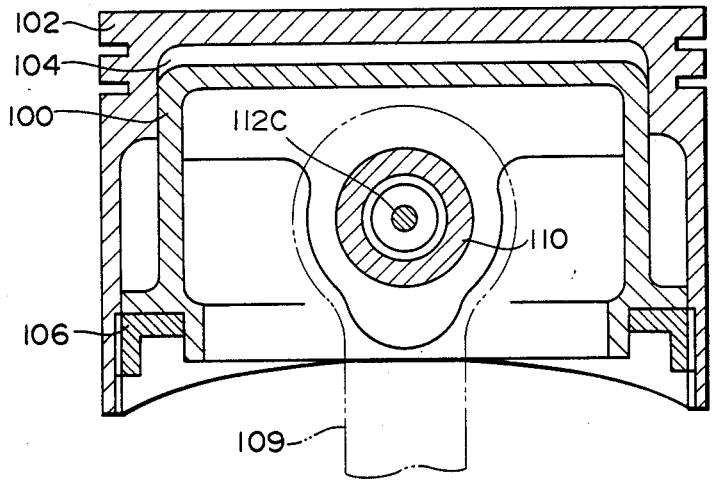

A spring 118 is disposed between the large diameter land 112A of the spool valve element 112 and the stopper member 116 and arranged to bias the spool valve element 112 toward the position illustrated in FIG. 3.

An essentially cylindrical valve chamber 120 defined in the stepped bore between the lands 112A, 112B of the spool valve element 112 communicates with a source of hydraulic fluid under pressure (e.g. engine lubrication oil pump 150) by way of a first passage 122 formed through the connecting rod 109 and a radial bore 124 formed in the piston pin 110. A one-way ball valve 122A is disposed in the upstream end of the passage 122 (viz., the end closest the piston) and arranged to permit hydraulic fluid to flow only toward the piston arrangement and into the cylindrical chamber 120.

A supply passage structure via which the cylindrical chamber 120 is fluidly communicated with the first variable volume chamber 104 includes a radial bore 126 formed in the piston pin 110, a groove 128 formed in the inner periphery of the through bore formed in the inner piston in which the piston pin 110 is received, and a bore 130 which leads from the groove 128 to the crown of the inner piston 100. The latter mentioned bore 130 is partially drilled out and a one-way ball valve 132 disposed therein. This valve 132 prevents the flow of hydraulic fluid from the first variable volume chamber 104 back through the first passage structure.

A drain passage structure which communicates the first variable volume chamber 104 with the stepped bore in which the spool valve element 112 is disposed, is formed in manner which is essentially the same as supply passage structure. Accordingly, this structure is denoted by the single numeral 134 for simplicity.

The second annular variable volume chamber 104 communicates with the cylindrical valve chamber 120 via a communication passage structure which includes a radial bore 136, a channel 138 formed in the inner periphery of the through diametrically extending bore of the inner piston 100, and an elbow shaped bore 140 which leads from the groove 138 to the second annular variable volume chamber 108. A second one-way valve 142 is disposed in the elbow shaped bore 140 and arranged to prevent the reverse flow of hydraulic fluid out of the chamber 108.

A transfer passage 144 is arranged to lead from the groove 138 of the communication passage structure to the crown of the inner piston 100. In this instance the upper end (as seen in the drawings) of the passage is bored out and a flow restricting orifice 144A disposed therein.

When the hydraulic pressure prevailing in the cylindrical chamber 120 is at a level less than that which overcomes the bias of the spring 118, the spool valve element 112 assumes the position illustrated in FIG. 3. In this position land 112B of the spool valve element 112 close the radial bore associated with the drain passage 134 while the large diameter land 112A assumes a position wherein a restricted communication between the cylindrical chamber 120, the transfer passage 114 and the communication passage 140 is established via the annular clearance defined between the bore and the reduced diameter land section 112A'. The annular clearance is such as to act as a flow restriction which limits the amount of hydraulic fluid which can flow between the cylindrical valve chamber 120 and the transfer and communication passage arrangements.

While the spool is in the position illustrated in FIG. 3, a limited amount of hydraulic fluid is permitted to flow from the cylindrical chamber 120 out through the communication passage 138 the annular variable volume chamber 108. This restriction is, in combination with the limited rate at which hydraulic fluid can leak out of the chamber 108, such as to maintain the pressure in the cylindrical valve chamber 120 approximately at the supply pressure level. This limited flow facilitates cylinder bore wall lubrication.

Figure 5:
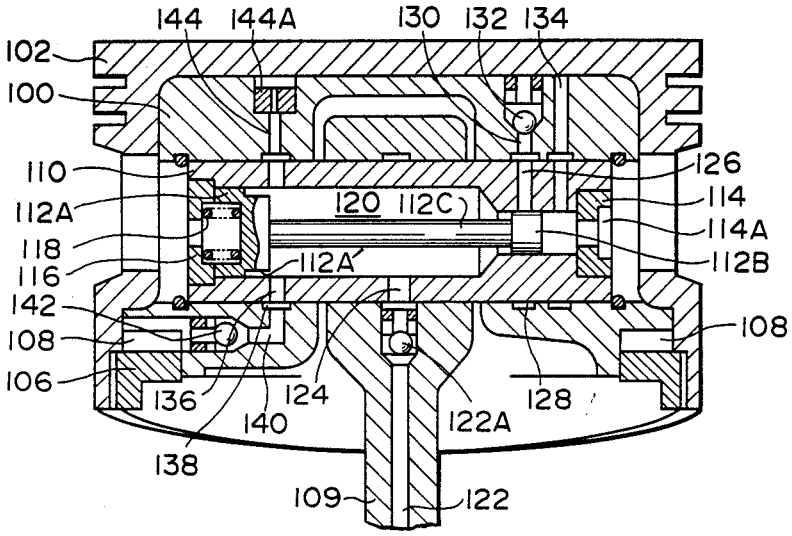
FIGS. 5 and 6 are front and side sectional elevations of the first embodiment of the present invention conditioned for low compression ratio engine operation.
Figure 6:
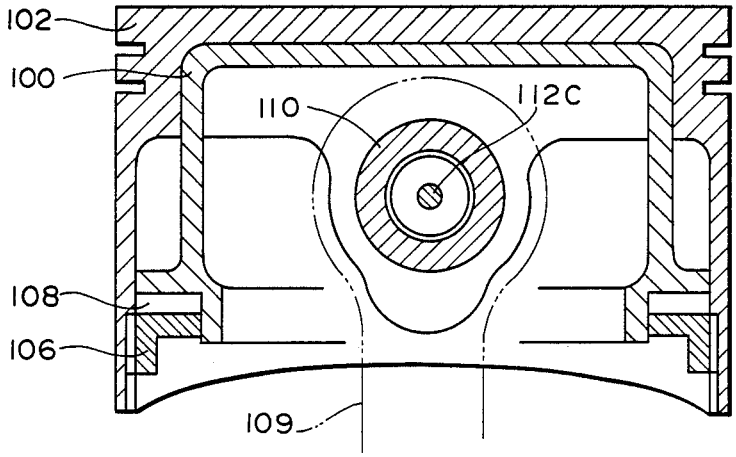

However, when the pressure in the chamber 120 increased beyond that which can be resisted by the spring 118, the spool valve element 112 moves the position illustrated in FIG. 5. In this position the communication and transfer structures are placed in full communication with the cylindrical valve chamber 120, the supply passage 130 isolated therefrom and the drain passage 134 opened in a manner which permits the hydraulic fluid in the first variable volume chamber 104 to drain out through the end of the piston pin 110 as shown by the arrow.

OPERATION

When an engine is operating under light load it is advantageous from various points of view to when the engine is operating under high load is deemed advantageous to lower the compression ratio. As pointed out above this form of compression control is highly advantageous in that, at low engine speeds A higher compression provides good engine response and acceleration while at higher engine speeds a lower compression ratio permit the engine speed to be increased without the fear of engine knock and/or in the worst case severe engine damage.

Further as mentioned earlier this type of control also lends itself advantageously to use in Diesel engines which inherently have a high compression ratio. Viz., with Diesel engines the high compression ratio leads, under certain modes of engine operation, to the situation wherein the friction loss causes a power output reduction.

(1) LOAD LOAD/HIGH COMPRESSION

When an engine is operating under low load, the combustion pressure which develops in the combustion chamber (cylinder) is lower than when the engine is operating under high load. The present invention makes use of this characteristic for control purposes and in a manner which advantageously renders it unnecessary to provide valves, sensors and control circuits for the purpose of switching between modes.

That is to say, when the piston is descending during induction and exhaust strokes for example, the pressure acting on the upper surface of the outer piston is relatively low and/or negative. The drag which occurs between the outer piston and the cylinder bore wall tends induce the inner and outer pistons to separate.

Accordingly, under these circumstances the force acting on the outer piston 102 which tends to reduce the volume of the variable volume chamber 104, is low and/or negative and the hydraulic fluid which is supplied into the cylindrical valve chamber 120 via supply passage 122 readily flows through the supply passage structure 126, 130, 132. As this passage structure is not restricted by a spring biased valve member such as used in the prior art, the variable volume chamber 104 tends to quickly fill.

On the subsequent upward return stroke (during low load operation) as the pressures which develop during the compression and expansion phases of engine operation are reactively low, the hydraulic fluid which is contained in the chamber 104 is pressurized only to what shall be referred to as a "low" level. This pressure is transmitted to the cylindrical valve chamber 120 via the transfer passage 144 and orifice 144A The provision of the orifice 144A and the annular clearance defined about the small diameter portion of the land 112A, limits chamber 104.

Under these conditions, the drain passage is closed by the land 112B, displacement of hydraulic fluid back through passage 122 is prevented by one-way ball valve 122A (and tho presence of pump pressure therein), and the only passage via which pressure can be relieved is via the narrow annular clearance defined between the small diameter portion of land 112A and the bore wall, and communication passage 140. However, due to the partially sealed nature of the annular chamber 108 the amount of pressure relief is small and as result, the pressure prevailing in the cylindrical valve chamber 120 rises. However, in this instance the pressure is not sufficient to overcome the bias of spring 118 and the spool 112 remains in the position illustrated in FIG. 3.

Accordingly, as hydraulic fluid can enter the chamber 104 more easily than it can be displaced, it tends to become filled ("pumped up") to the point wherein further movement of the outer piston 102 with respect to the inner one is mechanically limited by the retainer 106 abutting the bottom of the inner piston 100. The liquid retained in the chamber 10 acts as a quasi-solid body upon being compressed.

It will be noted however, that a small amount of hydraulic fluid tends to be circulated through chamber 104 by the "pumping" action which tends to occur as a result of the sequential application of low and high pressures on the crown of the outer piston. Viz., a small amount of hydraulic fluid tends to be inducted during applications of low or negative pressures while a little is displaced during the application of compression and combustion pressures. This circulation cools the structure defining chamber 104 and obviates the formation of gummy deposits and the like.

(2) HIGH LOAD/LOW COMPRESSION

When the load on the engine increases and induces a marked increase in the compression and combustion pressures, the force acting on the piston crown increases and increases the pressure of the hydraulic fluid in the chamber 104 to a "high" level. The pressure increase is transmitted to the cylindrical valve chamber 120 via the orifice 144A and annular clearance in a manner wherein the pressure in the cylindrical valve chamber 120 increases to a level whereat the spool valve 112 moves against the bias of the spring 118 and assumes the position illustrated in FIG. 5. In this position the drain passage 134 is opened and the hydraulic fluid in the first variable volume chamber 104 is permitted to exhaust out through the end of the piston pin 110. Simultaneously, the flow restricting influence of the annular clearance is removed and hydraulic fluid under pressure is supplied into the second annular variable volume chamber 108. The pressurization of chamber 108 generates a bias which tends to drive the outer piston 102 down into abutment with the inner one 100 and thus assume the relationship shown in FIG. 4.

During the downstroke of the piston during the induction phase, for example, the force acting on the piston crown decreases. This permits a small amount of hydraulic fluid to enter the first variable volume chamber 104 via the orifice 144A. Subsequently, during the compression and expansion phases of the engine, the small amount of hydraulic fluid which is in the first variable volume chamber 104 tends to be squeezed out through the drain passage arrangement. The cyclic repetition of this induces a small cooling flow of hydraulic fluid through the first variable volume chamber 104 which obviates the degradation of the oil and the subsequent formation of gummy tar deposits.

In the event that the load on the engine suddenly reduces, such as during deceleration or the like, the force compressing chamber 104 during the compression and expansion strokes reduces, the pressure prevailing in the cylindrical valve chamber 120 reduces and the spool valve element 112 is permitted to return the position shown in FIG. 3.

The piston is subsequently reconditioned for high compression operation and thus facilitates engine braking and/or new demands for acceleration.

As the volume of hydraulic fluid in the first variable volume chamber 104 increases, the hydraulic fluid in the second chamber 108 is permitted to leak out through the interface between the inner piston 100 and the annular retainer 106. This leakage damps the ascent of the outer piston 102 with respect to the inner one and smooths the change over.

SECOND EMBODIMENT

Figure 7:
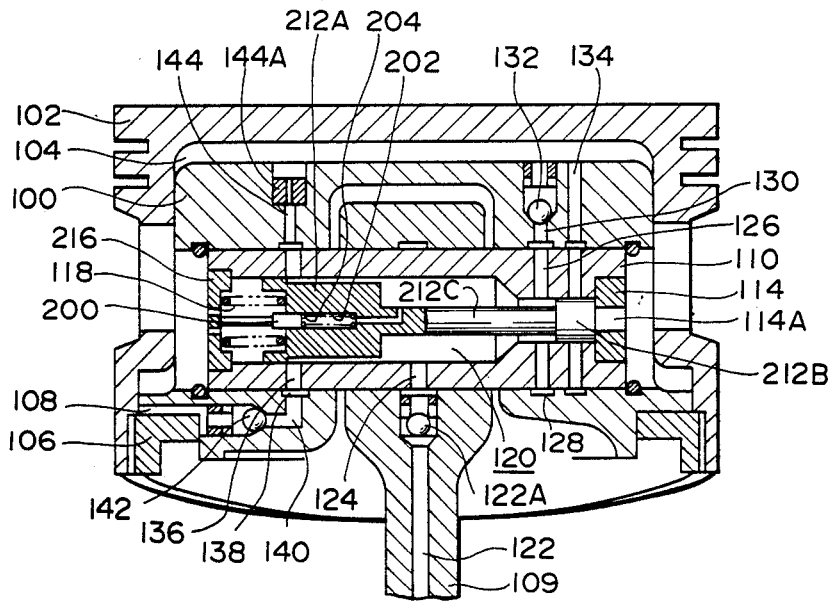
FIG. 7 is a front sectional elevation showing a second embodiment of the present invention conditioned for low compression ratio engine operation.
Figure 8:
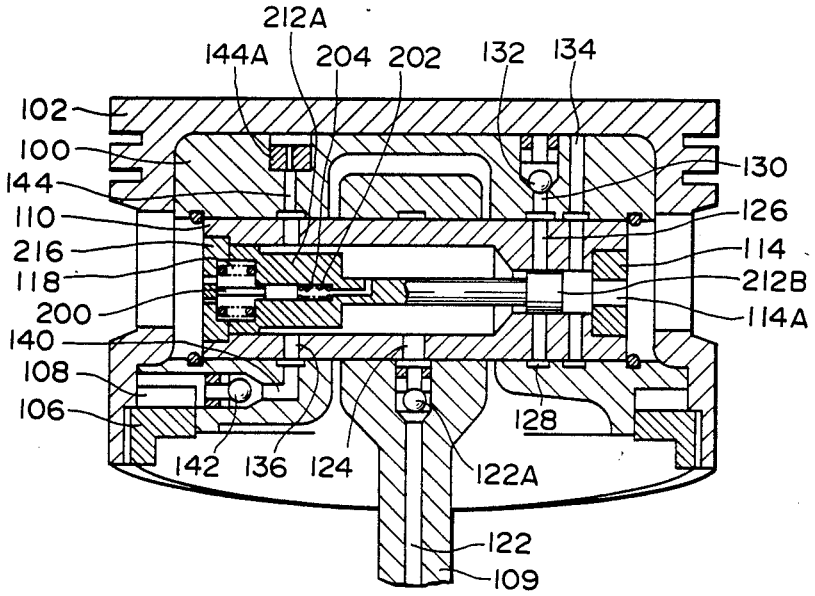
FIG. 8 is a front sectional elevation showing the second embodiment conditioned for low compression operation.
Figure 9:
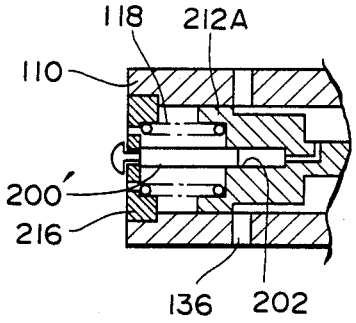
FIG. 9 is an enlarged view showing a valve arrangement which forms a vital part of the second embodiment.

FIGS. 7 to 9 show a second embodiment of the present invention. This arrangement differs from the first one in that a damping device is included in the spool valve 212 which controls the flow of hydraulic fluid to the various chambers and passages of the device.

As shown, this damping device comprises a small diameter piston-like valve element 200 which is reciprocatively disposed in a coaxial stepped bore 202 formed in the large diameter land 212A of the spool valve 212. This piston 200 (as it will be referred to) comprises a shaft-like member which is arranged to abut a central portion of the stopper member 216 at one end thereof and be received in the large diameter portion of the coaxial bore 202 at the other. A spring 204 is disposed between the step in the bore 202 and the inboard face of the valve element 200 and arranged to bias the piston outwardly into contact with the stopper 216.

A small diameter radial bore (no numeral) is formed through the shaft section 212C of the control valve 212 at a location intermediate of the two lands 212A and 212B. This radial bore intersects with the small diameter section of the stepped bore 202 and establishes fluid communication between the cylindrical valve chamber 120 and the variable volume damper chamber defined by the piston 200 in the stepped bore 202.

Other than this construction the arrangement of the second embodiment is essentially the same as that of the first one and as such a redundant disclosure of the same will be omitted for brevity.

FIG. 9 shows a variant of the second embodiment. In this arrangement the spring 204 is omitted and the outboard end of an essentially rod-like piston member 200' is riveted or otherwise fixedly connected with the stopper 216.

In operation the second embodiment is such that when the pressure level of the hydraulic fluid which is supplied through passage 122 and one-way valve 122A into the cylindrical valve chamber 120, is below that which overcomes the bias of the spring 118 the spool valve 212 assumes the position illustrated in FIG. 7. In this position the spool valve 212 induces the same communication arrangement as does valve 112 of the first embodiment when in the same position and conditions the device for high compression engine operation.

However, when the hydraulic fluid pressure is increased due to an increase in engine load, and the spool valve 212 is biased to move toward the position illustrated in FIG. 8, movement is resisted by the displacement of the hydraulic fluid from the damper chamber back into the cylindrical valve chamber 120. Conversely, when the pressure is switch a lower level and the spool valve 212 is biased to move toward the position illustrated in FIG. 7 hydraulic fluid is inducted into the damper chamber via the radial bore and small diameter section of the stepped bore 202.

Accordingly, the second embodiment features an arrangement whereby noise which tends to be produced by the spool valve element 212 knocking against the stopper members 114 or 216 (particularly the latter) tends to be obviated and smooth and quiet switching is achieved.

As the effective surface area of the damper piston 200 is very small as compared with that of the land 212A no noticeable effect is produced other than the damping operation.

THIRD EMBODIMENT

Figure 10:
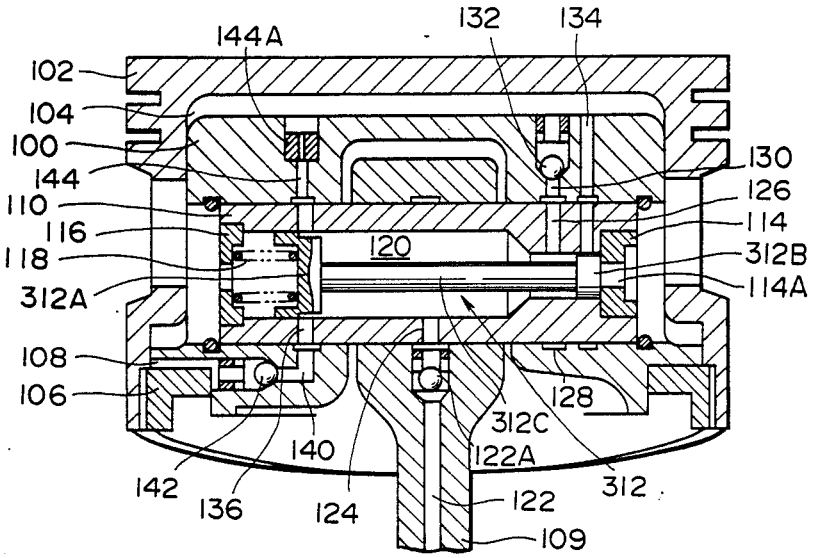
FIGS. 10 and 11 are sectional elevations showing a third embodiment of the present invention conditioned for high and low compression ratio operations, respectively.
Figure 11:
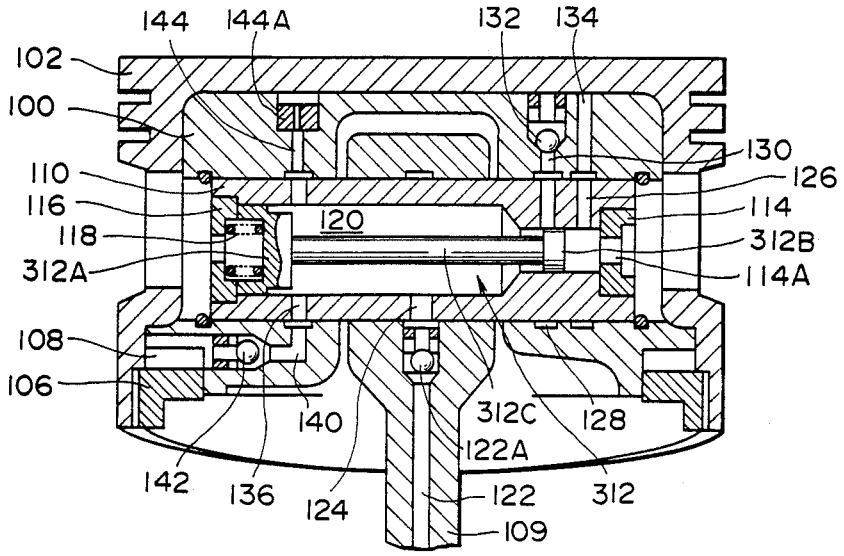

FIGS. 10 and 11 show a third embodiment of the present invention In this arrangement the length of the spool valve 312 and the width of the small diameter land 312B are selected so that when the valve assumes the position illustrated in FIG. 10 the drain passage 134 is closed and the supply passage is fully opened. However, upon moving to the position shown in FIG. 11 in response to an increase in hydraulic fluid pressure in the cylindrical valve chamber 120, the supply passage 130 is only partially closed off and a restricted communication between the cylindrical valve chamber 120 and the variable volume chamber 104 is established. This permits a small amount of hydraulic fluid to flow from the cylindrical valve chamber 120 through the supply passage 130 into the chamber 104 during low compression engine operation. Accordingly, when the piston is descending during induction and exhaust phases the tendency for the inner and outer pistons 100 and 102 to separate and cause a negative pressure to be created in chamber 104 is prevented. This obviates the tendency for air or the like crankcase gas of the engine to be sucked in through drain passage 130 and become trapped in chamber 104 and/or find its way into cylindrical valve chamber 120 and/or other sections of the device is prevented.

Accordingly, the second embodiment features means for preventing contamination of the system with non-condensable matter or the like which tends to interfere with the proper operation of the device.

FOURTH EMBODIMENT

Figure 12:
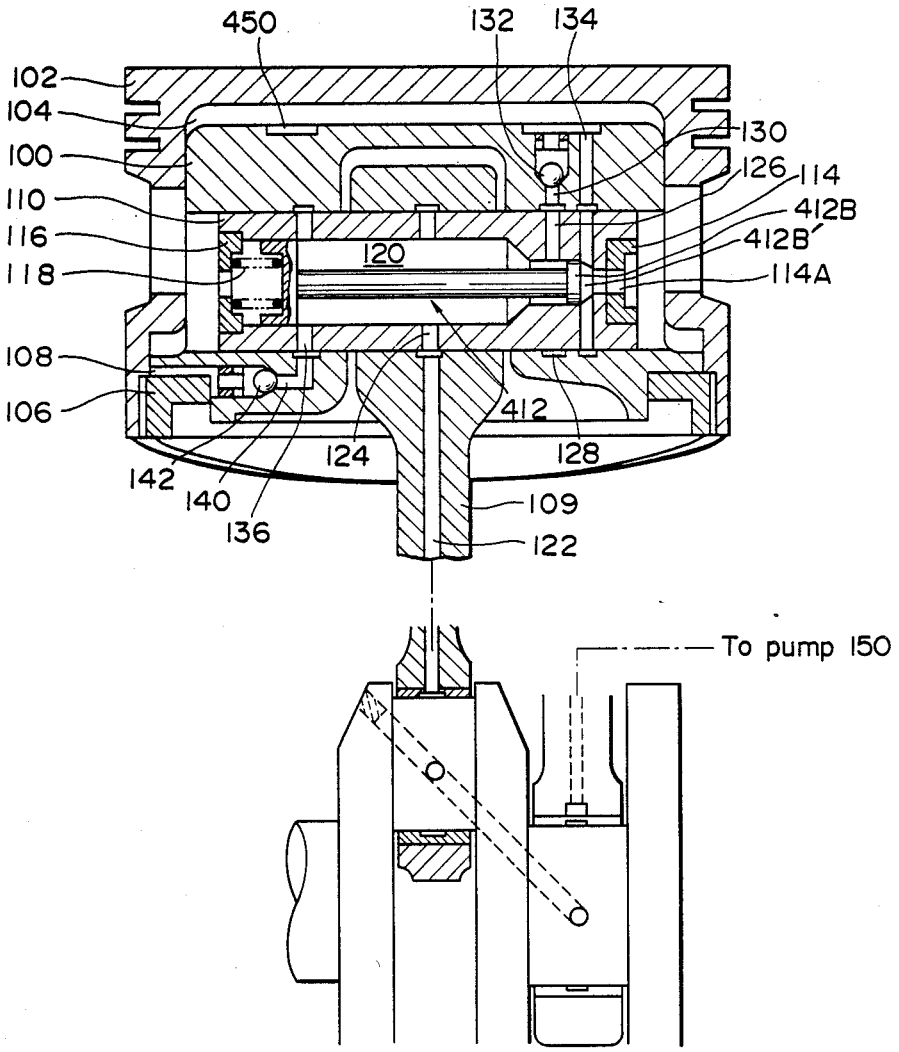
FIGS. 12 and 13 are sectional elevations showing a fourth embodiment of the present invention.
Figure 13:
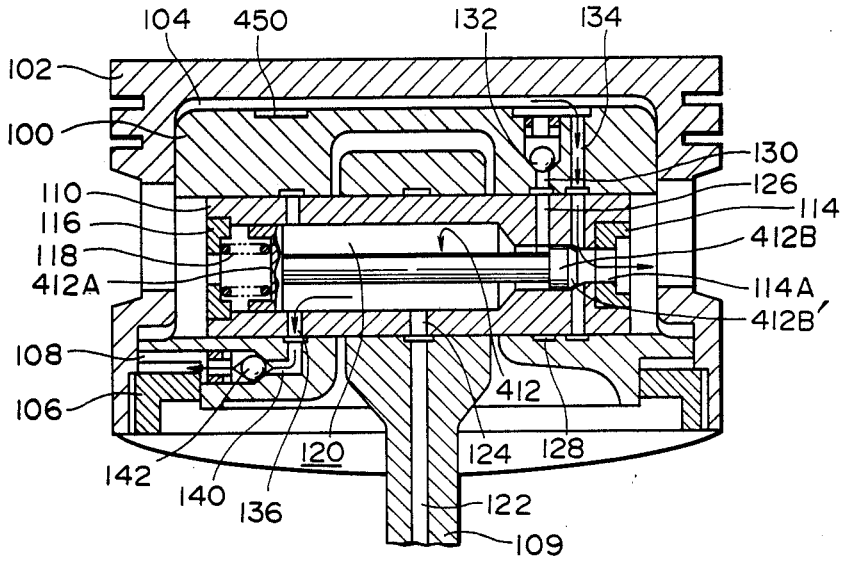

FIGS. 12 and 13 show a fourth embodiment of the present invention. This arrangement is characterized by the omission of the transfer passage structure which is used in the preceding embodiments and in that the small diameter land 412B of the spool valve 412 is provided with a chamfered section 412B' at the outboard end thereof.

The portion of the piston pin 110 against which the outboard end of the land 412B is arranged to abut is formed with a taper against which the chamfer seats when the pressure in cylindrical valve chamber 120 is below the level which overcomes spring 118.

As shown, the drain passage 130 is arranged to open into the tapered section.

With this arrangement due to the omission of the transfer passage structure the pressure prevailing in the cylindrical valve chamber 120 is isolated from the changes which occur in the chamber 104.

Accordingly, this pressure tends to remain essentially constant and thus the provision of a one-way valve in conduit 122 is rendered unnecessary.

With the drain passage structure which characterizes the instant embodiment the pressure which develops in the chamber 104 is permitted to act directly on the surface of the chamfer provided on the land 412B. This pressure produces a force which acts against the bias of the spring 118 and which tends to move the spool valve 412 to the right as seen in the drawings and in direction which tends to open the drain port 114A.

The fourth embodiment is arranged such that the pressure which develops during low load engine operation is insufficient to overcome the bias of spring 118 and the spool assumes the position illustrated in FIG. 12. With the device thus conditioned during periods when the force which tends to compress the chamber 104 is low or negative, hydraulic fluid is permitted to pump up the chamber 104 to the point wherein the maximum separation between the inner and outer pistons is achieved.

However, When the load on the engine increases and the pressure which is correspondingly developed in chamber 104 reaches a predetermined level, the force developed by the pressure acting on the chamfered section of land 412B exceeds the bias produced by spring 118 and the spool 412 moves in manner which permits drain port 114A to open. This opening permits hydraulic fluid to be drained from chamber 104 a shown by the arrows in FIG. 13. Simultaneously hydraulic fluid is permitted to flow through the communication passage 140 into the annular variable volume chamber 108 as shown. When the pressure acting on the chamfer reduces such as during the induction stroke, drain port 114A is closed and hydraulic fluid is supplied through supply passage 130.

During compression and expansion phases the hydraulic fluid in chamber 104 is raised to the level which opens drain port 114A and the hydraulic fluid which enters the chamber is displaced. Cyclic repetition of this type of operation under high load operation conditions the device in the manner depicted in FIG. 14.

This embodiment further features a shallow channel or the like continuous recess 450 formed in the crown of the inner piston 100. As shown, both of the supply and drain passage structures open into this channel. Accordingly, even under modes of engine operation wherein the load is so high that volume of chamber 104 is reduced essentially to zero still an amount of hydraulic fluid can circulate therethrough for the purposes of cooling and preventing oil degradation.

FIG. 12 shows a possible passage arrangement which is formed in the crank shaft and associated connecting rods via which fluid communication between the pump and the cylindrical valve chamber 120 of the various embodiments can be achieved.

FIFTH EMBODIMENT

Figure 14:
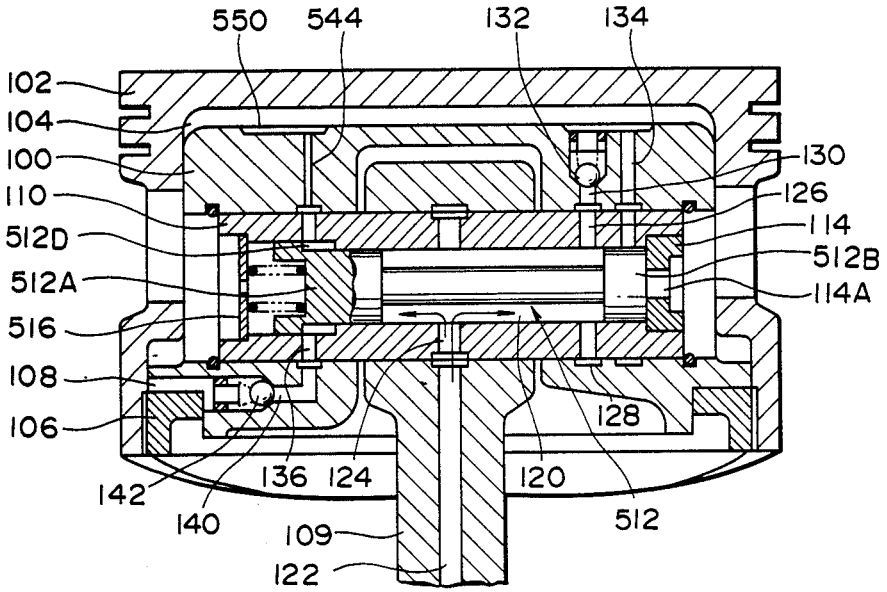
FIGS. 14 and 15 are view showing a fifth embodiment of the invention.
Figure 15:
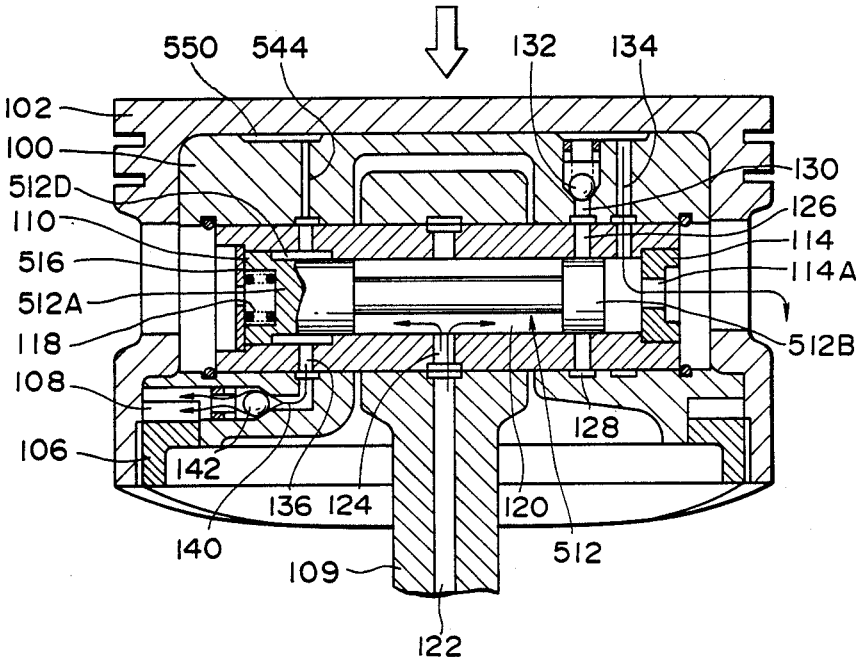

FIGS. 14 and 15 show a fifth embodiment of the present invention. This arrangement differs from the first embodiment in that the orifice 144A and passage 144 arrangement is replaced with a small diameter bore 544, the land 512B has a diameter equal to that of the smaller diameter portion of land 512A, and in that bore in which the spool 512 is disposed and land 512A are stepped in manner to define an narrow annular variable volume chamber 512D which is discrete from the cylindrical valve chamber 120. This annular chamber 512D is arranged to communicate with the flow restricting transfer passage 544 and the communication passage 140 in a manner which permits a limited amount of hydraulic fluid to flow from the variable volume chamber 104 to the annular chamber 108 at all times.

In this embodiment a channel is formed in the crown of the inner piston 100 and arranged to intercommunicate the transfer, supply and drain passage structures in a manner which facilitates the circulation of hydraulic fluid through the chamber 104 and through passages 544 and 104.

The operation of this embodiment is such that during low load engine load operation when the pressure which is generated in chamber 104 is relatively low, the pressure which is transmitted to, and which subsequently develops in the annular chamber 512D is insufficient to produce a force which acts against and overcomes the bias of the spring 118. Accordingly, under low engine load operation the spool 512 remains in the position illustrated in FIG. 14. Under these conditions the drain passage 134 remains closed and the chamber 104 is permitted to be "pumped up" to the high compression condition in the previously disclosed manner.

On the other hand, during high engine load operation the pressure prevailing in the annular chamber 512D is such as to increase during compression and expansion phases to a level whereat the bias of spring 118 is overcome and the spool moves to the position illustrate in FIG. 15. Drain port 114A is opened and the hydraulic fluid is permitted to drain from chamber 104.

During induction phases when the pressure acting on the outer piston crown reduces the pressure in chambers 104 and 512D reduce with the result that the spool moves and allows hydraulic fluid to be delivered into the chamber 104 via the supply passage 126. Subsequently, during compression and expansion phases the hydraulic fluid introduces is pumped out via the annular chamber 512D and communication passage 140 as indicated in FIG. 15. A shallow channel is formed in the crown of the inner piston 100 to facilitate this circulation when the engine load becomes sufficiently high as to pressure the outer piston down onto the crown of the inner one and reduce the volume of chamber 104 essentially to zero.

It will be appreciate that the present invention is not limited to the disclosed embodiments. The various modifications and changes which can be made will be apparent to those skilled in the art to which the instant invention pertains.

What is claimed is:

1. A variable compression piston comprising:

a first piston reciprocatively disposed in a cylinder, said first piston having an axial blind bore formed therein, said first piston being directly exposed to the pressure prevailing in said cylinder;

a second piston reciprocatively disposed in said axial blind bore to define a first variable volume chamber therein, said second piston being retained in said blind bore by a retainer, said retainer defining a non-hermetically sealed second variable volume chamber between it and said second piston;

a piston pin which operatively interconnects a connecting rod with said second piston;

means defining a passage structure which is fluidly communicable with a source of hydraulic fluid under pressure;

a stepped bore formed in said piston pin, said stepped bore being arranged to be in constant communication with said passage structure;

a supply passage formed in said second piston, said supply passage leading from said stepped bore to said first variable volume chamber, said supply passage including a first one-way valve;

a drain passage formed in said second piston, said drain passage fluidly communicating said first variable volume chamber with said stepped bore;

a transfer passage which leads from said first variable volume chamber to said stepped bore, said transfer passage including means for restricting the flow of hydraulic fluid therethrough;

a spool valve reciprocatively disposed in said stepped bore, said spool valve being movable between first and second positions and biased by a spring toward said first position, said spool having first, second and third lands, said first land having the same diameter as said second land and said third land having a diameter which is larger than said first and second lands, said first and second lands being reciprocatively disposed in a first portion of said stepped bore to define an essentially cylindrical chamber therein, said cylindrical chamber constantly communicating with said source, said third land being reciprocatively received in a second portion of said stepped bore to define a variable volume annular chamber, said annular chamber communicating with said transfer passage;

said first land closing said drain passage and establishing fluid communication between said supply passage and said source when said spool assumes said first position, said first land opening said drain passage and one of closing and restricting the fluid communication between said source and said supply passage when it assumes said second position.

2. A variable compression piston comprising:

a first piston reciprocatively disposed in a cylinder, said first piston having an axial blind bore formed therein, said first piston being directly exposed to the pressure prevailing in said cylinder;

a second piston reciprocatively disposed in said axial blind bore to define a first variable volume chamber therein, said second piston being retained in said blind bore by a retainer, said retainer defining a non-hermetically sealed second variable volume chamber between it and said second piston;

a piston pin which operatively interconnects a connecting rod with said second piston;

means defining a passage structure which is fluidly communicable with a source of hydraulic fluid under pressure;

a stepped bore formed in said piston pin, said stepped bore being arranged to be in constant communication with said passage structure;

a supply passage formed in said second piston, said supply passage leading from said stepped bore to said first variable volume chamber, said supply passage including a first one-way valve;

a drain passage formed in said second piston, said drain passage fluidly communicating said first variable volume chamber with said stepped bore;

a transfer passage which leads from said first variable volume chamber to said stepped bore, said transfer passage including means for restricting the flow of hydraulic fluid therethrough;

a spool valve reciprocatively disposed in said stepped bore, said spool valve being movable between first and second positions, said spool having first and second lands, said first land having a smaller diameter than said second land, said spool being biased by a spring toward said first position, said first and second lands defining an essentially cylindrical chamber within said stepped bore, said cylindrically chamber constantly communicating with said source;

said first land closing said drain passage and establishing fluid communication between said supply passage and said source when said spool assumes said first position, said first land opening said drain passage and one of closing and restricting the fluid communication between said source and said supply passage when it assumes said second position, said second land cooperating with said transfer passage, said second land having a reduced diameter portion which defines an annular clearance between it and the wall of said stepped bore, said reduced diameter portion juxtaposing said transfer passage when said spool assumes said first position in a manner that communication between said transfer passage and said cylindrical chamber is established through said annular clearance, said second land defining a surface area against which the pressure prevailing in said cylindrical chamber acts to produce a bias which tends to move said spool from said first position to said second position against the bias of said spring.

3. A variable compression piston as claimed in claim 2 further comprising a damping arrangement which damps the movement of said spool in said stepped bore, said damping device comprising:

a second stepped bore formed in said spool;

a piston reciprocatively disposed in said second stepped bore, said piston being arranged to be essentially stationary with respect to said spool, said piston defining a third variable volume chamber within said second stepped bore, said stepped bore being fluidly communicated with sad cylindrical chamber by way of a small diameter flow restricting passage.

4. A variable compression piston as claimed in claim 2 wherein said spool is received in said stepped bore to define an annular variable volume chamber, said annular variable volume chamber being fluidly discrete from said cylindrical chamber and fluidly communicated with said transfer passage, the pressure prevailing in said annular variable volume chamber producing a bias which tends to move said spool toward said second position.

5. A variable compression piston as claimed in claim 2, wherein the reduced diameter portion of said second land has the same diameter as said first land.

6. A variable compression piston as claimed in claim 2 wherein the surface area of said second land which is exposed to the pressure prevailing in said cylindrical chamber is the same as the area of said first land which is exposed to the pressure prevailing in said cylindrical chamber.

7. A variable compression piston as claimed in claim 2 wherein said first land is formed with a surface which is exposed to the pressure prevailing in said drain passage to produce a bias which tends to move said spool toward said second position against the bias of the spring, and said second land being arranged so that the pressure prevailing in said cylindrical chamber biases said spool toward said second position against the bias of the spring.

8. A variable compression piston as claimed in claim 2 further comprising a communication passage which leads from said stepped bore to said second variable volume chamber, said communication passage including a second one-way valve which prevents hydraulic fluid from flowing from said second variable volume chamber to said stepped bore.

9. A variable compression piston as claimed in claim 8 further comprising a third one-way valve, said third one-way valve being disposed in a passage which interconnects said source and said stepped bore, said third one-way valve preventing the flow of hydraulic fluid from said stepped bore toward said source.

10. In an internal combustion engine a cylinder;

a first piston reciprocatively disposed in said cylinder, said first piston having an axial blind bore formed therein, said first piston being directly exposed to the pressure prevailing in said cylinder;

a second piston reciprocatively disposed in said axial blind bore to define a first variable volume chamber therein, said second piston being retained in said blind bore by a retainer, said retainer defining a second annular variable volume chamber between it and said second piston;

a piston pin which operatively interconnects a connecting rod with said second piston;

a valve bore formed in said piston pin, said valve bore being arranged to be in constant communication with a source of hydraulic fluid under pressure;

a supply passage formed in said second piston, said supply passage leading from said valve bore to said first variable volume chamber;

a drain passage formed in said second piston, said drain passage fluidly communicating with said first variable volume chamber;

a valve element disposed in said valve bore, said valve element being responsive to the pressure prevailing in said first variable volume chamber and arranged so that when the pressure in said first variable volume chamber is below a predetermined value, said valve element assumes a first position wherein drain passage is cut-off and communication between said first variable volume chamber and said supply passage is fully established, and when the pressure in said first variable volume chamber is above said predetermined value, said valve element assumes a second position wherein communication between valve bore and said first variable volume chamber by way of said supply passage is one of cut-off and restricted and said drain passage is opened said valve bore comprising a stepped bore formed in said piston pin, and wherein said valve element comprises a spool having first and second lands, said first land being arranged to cooperate with said supply and drain passages.

11. An internal combustion engine as claimed in claim 10 wherein said valve element has a pressure responsive area exposed to the pressure prevailing in said drain conduit, said pressure responsive area producing a bias Which acts in a direction which tends to move said valve element toward said second position, said valve element being biased toward said first position by a spring.

12. An internal combustion engine as claimed in claim 10, further comprising a first one-way valve disposed in said supply passage, said first one-way valve being arranged to prevent the flow of hydraulic through said supply passage.

13. An internal combustion engine as claimed in claim 10 further comprising, a communication passage, said communication passage leading from said valve bore to said second variable volume chamber;

a second one-way valve disposed in said communication passage, said second one-way valve being arranged to prevent the flow of hydraulic fluid from said second annular variable volume chamber to said valve bore.

14. An internal combustion engine as claimed in claim 10 wherein said first land is smaller in diameter than the second land.

15. An internal combustion engine as claimed in claim 10 further comprising:

a channel formed in at least one of the first and second pistons, said channel providing fluid communication between said supply passage and said drain passage when said second piston is in abutment with the end of the blind bore formed in said first piston.

16. An internal combustion engine as claimed in claim 10 further comprising a transfer passage formed in said second piston, said transfer passage leading from said first variable volume chamber to said valve bore, said valve element having a pressure responsive area which is exposed to the pressure which is transmitted from said first variable volume chamber to said valve bore.

17. An internal combustion engine as claimed in claim 16 further comprising a first spring, said first spring being arranged to bias said valve element toward said first position, said pressure responsive area being arranged so that the pressure which acts bias of said first spring.

* * * * *